US012660853B2

(12) United States Patent
Liu et al.

(10) Patent No.: US 12,660,853 B2
(45) Date of Patent: Jun. 23, 2026

(54) LIQUID CARTRIDGE ASSEMBLY FOR ELECTRONIC CIGARETTE AND ATOMIZER

(71) Applicant: CHINA TOBACCO HUNAN INDUSTRIAL CO., LTD., Changsha (CN)

(72) Inventors: Jianfu Liu, Changsha (CN); Kejun Zhong, Changsha (CN); Xiaoyi Guo, Changsha (CN); Wei Huang, Changsha (CN); Xinqiang Yin, Changsha (CN); Jianhua Yi, Changsha (CN); Lizhou Shen, Changsha (CN)

(73) Assignee: China Tobacco Hunan Industrial Co., Ltd., Changsha (CN)

( * ) Notice: Subject to any disclaimer, the term of this patent is extended or adjusted under 35 U.S.C. 154(b) by 934 days.

(21) Appl. No.: 17/640,321

(22) PCT Filed: Sep. 4, 2020

(86) PCT No.: PCT/CN2020/113451
§ 371 (c)(1),
(2) Date: Sep. 16, 2022

(87) PCT Pub. No.: WO2021/043255
PCT Pub. Date: Mar. 11, 2021

(65) Prior Publication Data

US 2023/0020762 A1 Jan. 19, 2023

(30) Foreign Application Priority Data

Sep. 6, 2019 (CN) ..... 201910841554.7
Sep. 6, 2019 (CN) ..... 201921486118.4
Sep. 6, 2019 (CN) ..... 201921493108.3

(51) Int. Cl.
*A24F 40/42* (2020.01)
*A24F 40/05* (2020.01)
(Continued)

(52) U.S. Cl.
CPC ..... *A24F 40/42* (2020.01); *A24F 40/05* (2020.01); *A24F 40/10* (2020.01); *A24F 40/44* (2020.01); *A24F 40/485* (2020.01)

(58) Field of Classification Search
None
See application file for complete search history.

(56) References Cited

U.S. PATENT DOCUMENTS 10,201,189 B1 2/2019 Qiu
2018/0289068 A1 10/2018 Liao et al.
2021/0378303 A1* 12/2021 Liu ..... B05B 17/0646

FOREIGN PATENT DOCUMENTS

CN 204317503 U 5/2015
CN 205947128 U 2/2017
(Continued)

OTHER PUBLICATIONS

EP3469933A1, Disposable Cigarette Cartridge, Atomizer, and Electronic Cigarette, (Year: 2019).*
(Continued)

*Primary Examiner* — Melvin C. Mayes
(74) *Attorney, Agent, or Firm* — MASCHOFF BRENNAN; Michael Mauriel; Ran Pang

(57) ABSTRACT

A liquid cartridge assembly for an electronic cigarette and an atomizer is disclosed. The liquid cartridge assembly comprises a liquid cartridge housing and a first plug fastened to each other, a liquid cartridge is disposed between the liquid cartridge housing and the first plug, the first plug is provided with a through groove communicated with the liquid cartridge, two ends of liquid guide cotton pass through the through groove to extend into the liquid cartridge, a plurality of second protrusions for squeezing the liquid guide cotton are disposed in the through groove and an air passing gap for supplementing air to the liquid cartridge is formed between
(Continued)

adjacent second protrusions. Additional aspects and related embodiments are disclosed further herein.

15 Claims, 8 Drawing Sheets

(51) Int. Cl.
*A24F 40/10* (2020.01)
*A24F 40/44* (2020.01)
*A24F 40/485* (2020.01)

(56) References Cited

FOREIGN PATENT DOCUMENTS

| | | | | | |
|---|---|---|---|---|---|
| CN | 207885675 | U | | 9/2018 | |
| CN | 109452691 | A | | 3/2019 | |
| CN | 208837110 | U | * | 5/2019 | A24F 7/00 |
| CN | 210642451 | U | | 6/2020 | |
| CN | 210642464 | U | | 6/2020 | |
| WO | WO-2018024004 | A1 | * | 2/2018 | B05B 17/0646 |
| WO | WO-2019110004 | A1 | * | 6/2019 | A24F 40/05 |
| WO | WO-2019242636 | A1 | * | 12/2019 | A24F 40/48 |
| WO | WO-2020187138 | A1 | * | 9/2020 | A24F 40/40 |
| WO | WO-2020187139 | A1 | * | 9/2020 | A24F 40/485 |
| WO | WO-2020221079 | A1 | * | 11/2020 | A24F 47/00 |
| WO | WO-2020259692 | A1 | * | 12/2020 | A24F 40/485 |

OTHER PUBLICATIONS

CN207885675U, Ultrasonic electronic cigarette is with leading oily mechanism and ultrasonic electronic smog core, electron cigarette (Year: 2018).*

WO-2018024004-A1 Translation (Year: 2018).*

International Search Report issued in International Application No. PCT/CN2020/113451 dated Nov. 27, 2020, 3 pages.

* cited by examiner

LIQUID CARTRIDGE ASSEMBLY FOR ELECTRONIC CIGARETTE AND ATOMIZER

CROSS REFERENCE TO RELATED APPLICATIONS

This application is a U.S. National Phase application under 35 U.S.C. § 371 of International Application No. PCT/CN2020/113451 filed on Sep. 4, 2020 and claims priority to Chinese Application No. 201921493108.3 filed on Sep. 6, 2019, Chinese Application No. 201910841554.7 filed on Sep. 6, 2019, and Chinese Application No. 201921486118.4 filed on Sep. 6, 2019.

FIELD OF THE INVENTION

The present invention relates to an electronic cigarette utensil, in particular to a liquid cartridge assembly for an electronic cigarette and an atomizer.

BACKGROUND OF THE INVENTION

In an ultrasonic electronic cigarette atomizer on the current market, an ultrasonic atomization piece includes a piezoelectric ceramic substrate and upper and lower surface electrodes respectively disposed on upper and lower surfaces of the piezoelectric ceramic substrate. When two poles of a power supply are connected to the upper surface electrode and the bottom surface electrode, the piezoelectric ceramic substrate can oscillate at a high frequency, so that e-liquid is atomized into smoke on the surface of the piezoelectric ceramic substrate. When the ultrasonic atomization piece is used to atomize the e-liquid, the ultrasonic atomization piece is equivalent to a capacitor in an atomization circuit, so the energy borne by the ultrasonic atomization piece cannot be released after the circuit is disconnected. When the circuit is connected again, the ultrasonic atomization piece instantaneously releases high energy to various components on a motherboard, so the components are easily burned, for example, MOS transistors are broken down by high voltage, which affects the normal operation of the circuit.

In order to solve this situation, a resistance board is connected between the upper surface electrode and the lower surface electrode of the ultrasonic atomization piece of the existing ultrasonic electronic cigarette atomizer, so that after the atomizer is powered off, the ultrasonic atomization piece and a resistor on the resistance board form a closed circuit, to consume the energy stored by the ultrasonic atomization piece itself after powered on and off, which ensures that the ultrasonic atomization piece can work normally after powered on again, and prevents the ultrasonic atomization piece from releasing instantaneous high voltage after powered on again to burn other electronic components. However, the assembly of the existing resistance board requires many parts and processes with high cost, and the resistor board is fixed to the upper surface electrode and the lower surface electrode of the ultrasonic atomization piece by screws or a solder to conduct electricity, which is prone to risk of insecure fixation such as pseudo soldering.

In addition, in the existing atomizer, liquid guide cotton is generally clamped and fixed by adjacent parts. Sometimes the liquid guide cotton is clamped too tightly, so that the liquid guide efficiency of the liquid guide cotton is reduced and dry burning easily occurs. Sometimes the liquid guide cotton is clamped too loosely, so that the liquid guide cotton easily falls off under the action of a spring that presses the liquid guide cotton against the ultrasonic atomization piece, and even liquid leakage occurs.

SUMMARY OF THE INVENTION

The technical problem to be solved by the present invention is to overcome the shortcomings of the prior art and provide a liquid cartridge assembly for an electronic cigarette and an atomizer, in which liquid guide cotton can be clamped tightly without affecting its liquid guide efficiency.

In order to solve the above technical problems, the present invention provides a liquid cartridge assembly for an electronic cigarette, including a liquid cartridge housing and a first plug fastened to each other, a liquid cartridge being disposed between the liquid cartridge housing and the first plug, wherein the first plug is provided with a through groove communicated with the liquid cartridge, two ends of liquid guide cotton pass through the through groove to extend into the liquid cartridge, a plurality of second protrusions for squeezing the liquid guide cotton are disposed in the through groove, and an air passing gap for supplementing air to the liquid cartridge is formed between adjacent second protrusions.

The liquid guide cotton is squeezed by the second protrusions after passing through the through groove, and is clamped in the groove, so as to prevent the liquid guide cotton from falling out of the through groove. The air passing gap between the adjacent second protrusions is used for ventilation. When smoking, some air in the atomization cavity enters the liquid cartridge from the air passing gaps, so that the liquid supply speed of the liquid cartridge is increased, to prevent the phenomenon of dry burning caused by an excessively slow liquid guide speed (if there is no air passing gap, air enters the liquid cartridge to replace e-liquid slowly, so that the liquid guide cotton is easily burned or the amount of smoke is small).

Further, a sealing body is disposed between the liquid cartridge housing and the first plug, so that e-liquid in the liquid cartridge will not leak through the gap between the liquid cartridge housing and the first plug. The sealing body is preferably a third protrusion integrally disposed on the first plug to make the assembly easier.

Further, an inclined surface inclined inward is formed in the through groove at a position corresponding to the sealing body, so that an avoiding space is formed in the through groove to avoid excessively slow liquid discharge when the sealing body is squeezed to deform inward and the liquid guide cotton is clamped too tightly.

Further, the second protrusions are arc-shaped.

Based on the same inventive concept, the present invention further provides an electronic cigarette atomizer, including the above-mentioned liquid cartridge assembly for an electronic cigarette.

Further, an atomization head assembly is inserted into a lower part of the liquid cartridge housing, the atomization head assembly includes an outer sleeve, a rib and a first groove are disposed at the lower part of the liquid cartridge housing, a second groove and a first protrusion are disposed on the outer sleeve of the atomization head assembly, the liquid cartridge housing is inserted into the outer sleeve of the atomization head assembly, the rib is inserted in the second groove, and the first protrusion is buckled in the first groove. In this way, the atomizer of the present invention forms a split atomizer in which the liquid cartridge assembly and the atomization head assembly can be separated from each other. When the e-liquid in the liquid cartridge assembly is used up or other failures occur, the e-liquid can be replaced by simple extraction and insertion. When the service life of the ultrasonic atomization piece ends, it can also be replaced by simple extraction and insertion.

Further, the outer sleeve is sleeved on a base, a lower part of the base is sleeved with a bottom cover, and an atomization sleeve is sleeved at middle parts of the base and the bottom cover; a first insulating seat, a resistance board, and a second plug are disposed in the atomization sleeve from top to bottom; an ultrasonic atomization piece in contact with the liquid guide cotton is disposed on the first insulating seat, an atomization cavity is formed between the ultrasonic atomization piece and the first plug, the bottom cover is provided with a first air inlet, the base is provided with a vertical air inlet groove and a second air inlet communicated with each other, the atomization sleeve is inserted in the base so that the vertical air inlet groove forms a vertical air inlet channel, an upper part of the atomization sleeve is provided with a transverse air inlet groove communicated with the atomization cavity, and the first air inlet, the vertical air inlet channel and the transverse air inlet groove are communicated with each other to form an air inlet channel of the atomization cavity; and an air outlet channel for guiding smoke in the atomization cavity out is formed in the liquid cartridge assembly.

Further, a lower part of the liquid cartridge housing is provided with a clamping hole, the first plug is provided with a clamping column, the first plug is inserted into the liquid cartridge housing, and the clamping column is clamped in the clamping hole, so that the first plug is installed stably.

Further, the electronic cigarette atomizer further includes a second plug serving as a first power connection terminal and an electrode sleeve serving as a second power connection terminal, a second insulating seat and the electrode sleeve are disposed at a middle part of the second plug, and the second insulating seat is disposed between the second plug and the electrode sleeve, wherein: the second plug, the second insulating seat and a lower part of the electrode sleeve are fastened together, an upper part of the electrode sleeve extends out of the second plug, and an inverted structure is disposed on top of the electrode sleeve, so that the upper part of the electrode sleeve forms an annular groove;

a resistance board is disposed on an upper surface of the second plug, and the resistance board is clamped into the annular groove of the electrode sleeve, so that the resistance board, the second plug, the second insulating seat and the electrode sleeve are fixed and combined with each other; and electrical connection ends are respectively disposed on upper and lower surfaces of the resistance board, an upper surface electrical connection end of the resistance board is directly electrically connected to the inverted structure of the electrode sleeve, and a lower surface electrical connection end of the resistance board is directly electrically connected to the second plug.

In this way, only the resistance board is inserted into the upper annular groove of the electrode sleeve to complete the assembly of the resistance board, the second plug, the second insulating seat and the electrode sleeve; and the upper and lower surfaces of the resistance board are directly electrically connected to the first and second power connection terminals without soldering, so that the assembly of the present invention is simple and convenient, the assembly time is effectively saved, and the assembly contact is more reliable.

Further, the resistance board is provided with a U-shaped groove, and the resistance board is clamped with the annular groove of the electrode sleeve via the U-shaped groove.

Further, in order to clamp the resistance board with the electrode sleeve firmly, the inverted structure is annular.

Further, a rib and a first groove are disposed on the lower outer circumference of the liquid cartridge housing, a second groove and a first protrusion are disposed on the inner wall of the outer sleeve of the atomization head assembly, the liquid cartridge housing is inserted into the outer sleeve of the atomization head assembly, and the rib is inserted in the second groove, so that the liquid cartridge assembly and the atomization head assembly cannot move relatively; the first protrusion is buckled in the first groove, so that the liquid cartridge assembly is fixed in the atomization head assembly and will not fall out; and the liquid guide cotton abuts against the ultrasonic atomization piece in the atomization head assembly. Further, a lower part of the liquid cartridge housing is provided with a clamping hole, the first plug is provided with a clamping column, the first plug is inserted into the liquid cartridge housing, and the clamping column is clamped in the clamping hole, so that the first plug is installed stably.

Further, the outer circumference of the resistance board and the inner wall of the atomization sleeve are separated by a short distance, so that the movable space of the assembled resistance board is small. Therefore, compared with the existing method of fixing by soldering, the risk of falling of the resistance board caused by pseudo soldering can be effectively avoided.

Further, the electronic cigarette atomizer further includes an atomization head assembly, an ultrasonic atomization piece in contact with the liquid guide cotton is disposed in the atomization head assembly, the upper surface electrode of the ultrasonic atomization piece is electrically connected to the second plug, and the lower surface electrode of the ultrasonic atomization piece is electrically connected to the electrode sleeve.

Further, the second plug is electrically connected to the upper surface electrode of the ultrasonic atomization piece via the atomization sleeve, and the electrode sleeve is electrically connected to the lower surface electrode of the ultrasonic atomization piece via a second spring.

In figures: 1—liquid cartridge assembly; 11—liquid cartridge housing; 12—first plug; 13—first spring; 14—liquid guide cotton; 15—liquid cartridge; 111—clamping hole; 112—rib; 113—first groove; 121—clamping column; 122—through groove; 123—third protrusion; 1221—second protrusion; 1222—air passing gap; 1223—inclined plane; 1224—avoiding space; 2—atomization head assembly; 21—ultrasonic atomization piece; 22—base; 23—bottom cover; 24—atomization sleeve; 25—first insulating seat; 26—resistance board; 27—second plug; 28—atomization cavity; 29—outer sleeve; 30—second insulating seat; 31—electrode sleeve; 32—second spring; 221—vertical air inlet groove; 222—second air inlet; 231—first air inlet; 241—transverse air inlet groove; 261—U-shaped groove; 262—upper surface electrical connection end; 291—first protrusion; 311—inverted structure; 312—annular groove; L—distance.

DETAILED DESCRIPTION OF THE EMBODIMENTS

The present invention will be further described below with reference to specific preferred embodiments, but the scope of protection of the present invention is not limited thereby.

For ease of description, the relative positional relationships (e.g., upper, lower, left, right, etc.) of components are described according to the layout direction of the accompanying drawings in the specification, and do not limit the structure of this patent.

Embodiment 1

Figure 1:
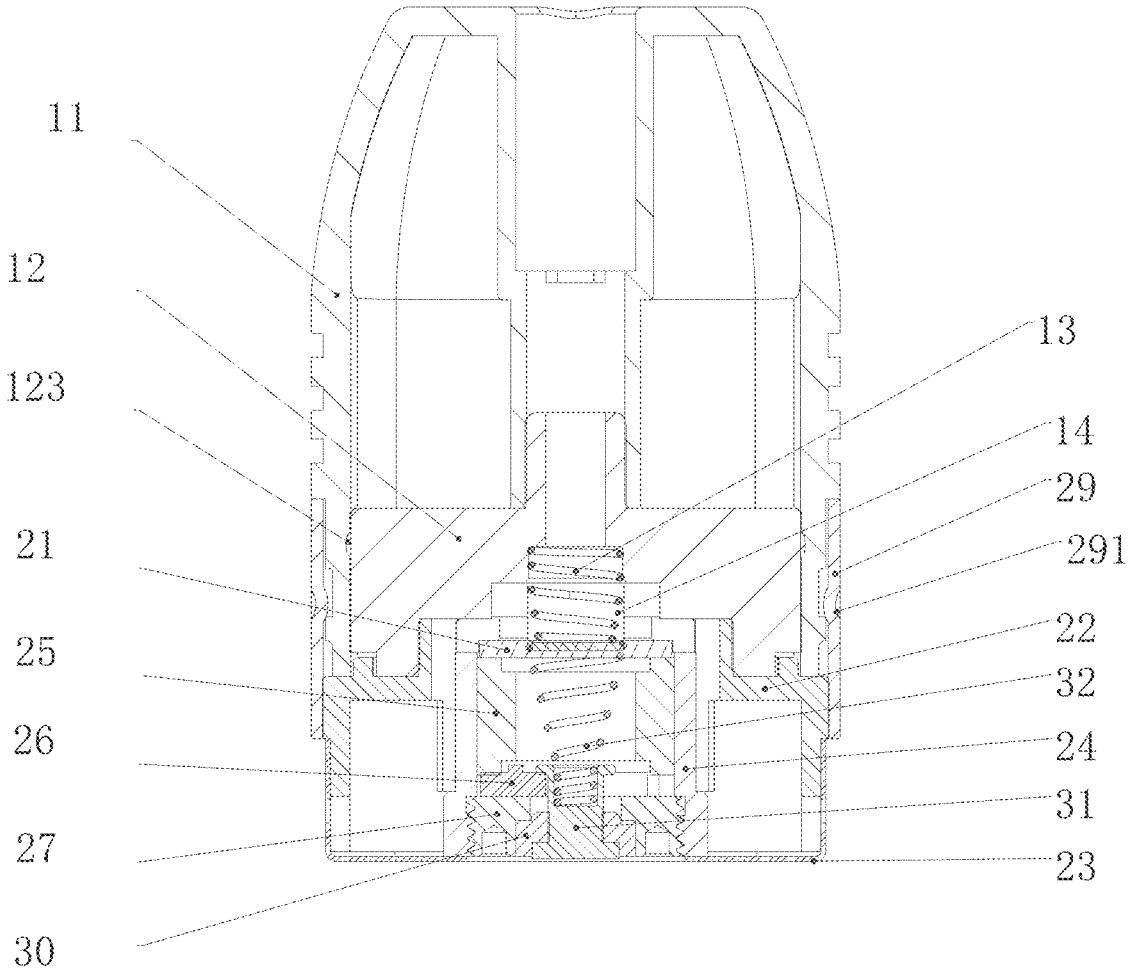
FIG. 1 is a cross-sectional structure diagram of an atomizer of the present invention.
Figure 2:
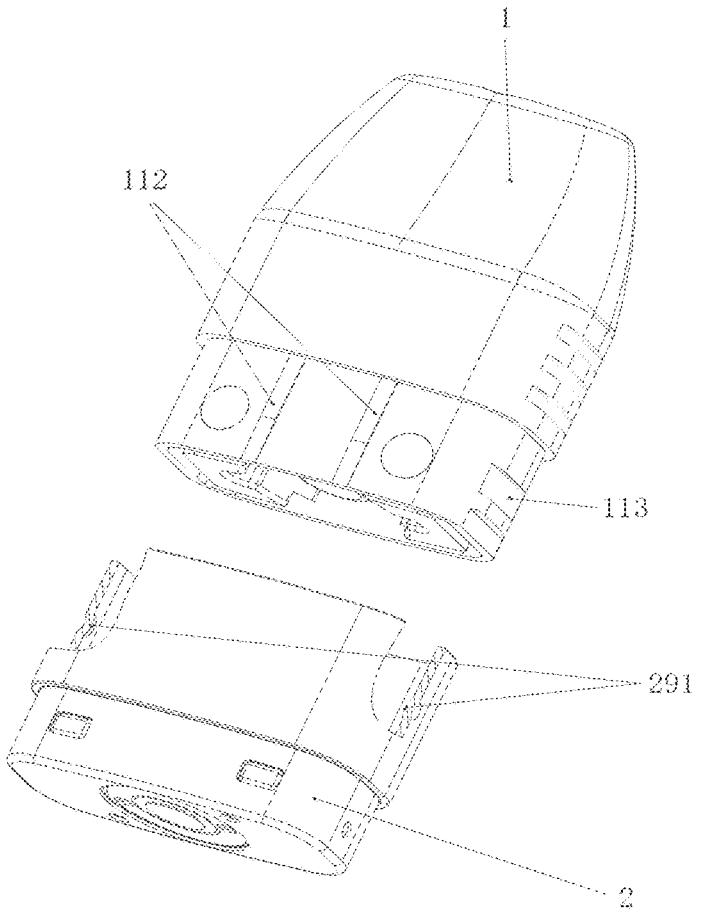
FIG. 2 is a separate structure diagram of a liquid cartridge assembly and an atomization head assembly of the present invention.
Figure 3:
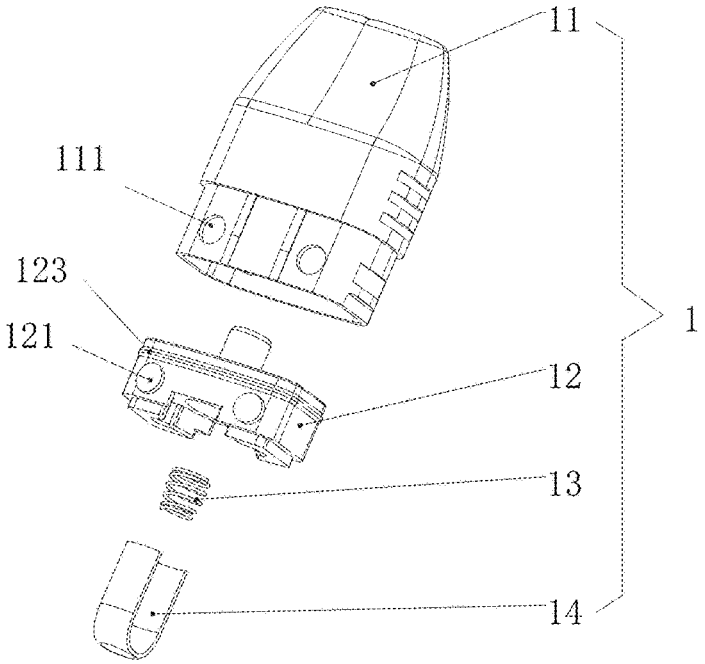
FIG. 3 is an exploded view of the liquid cartridge assembly of the present invention.
Figure 4:
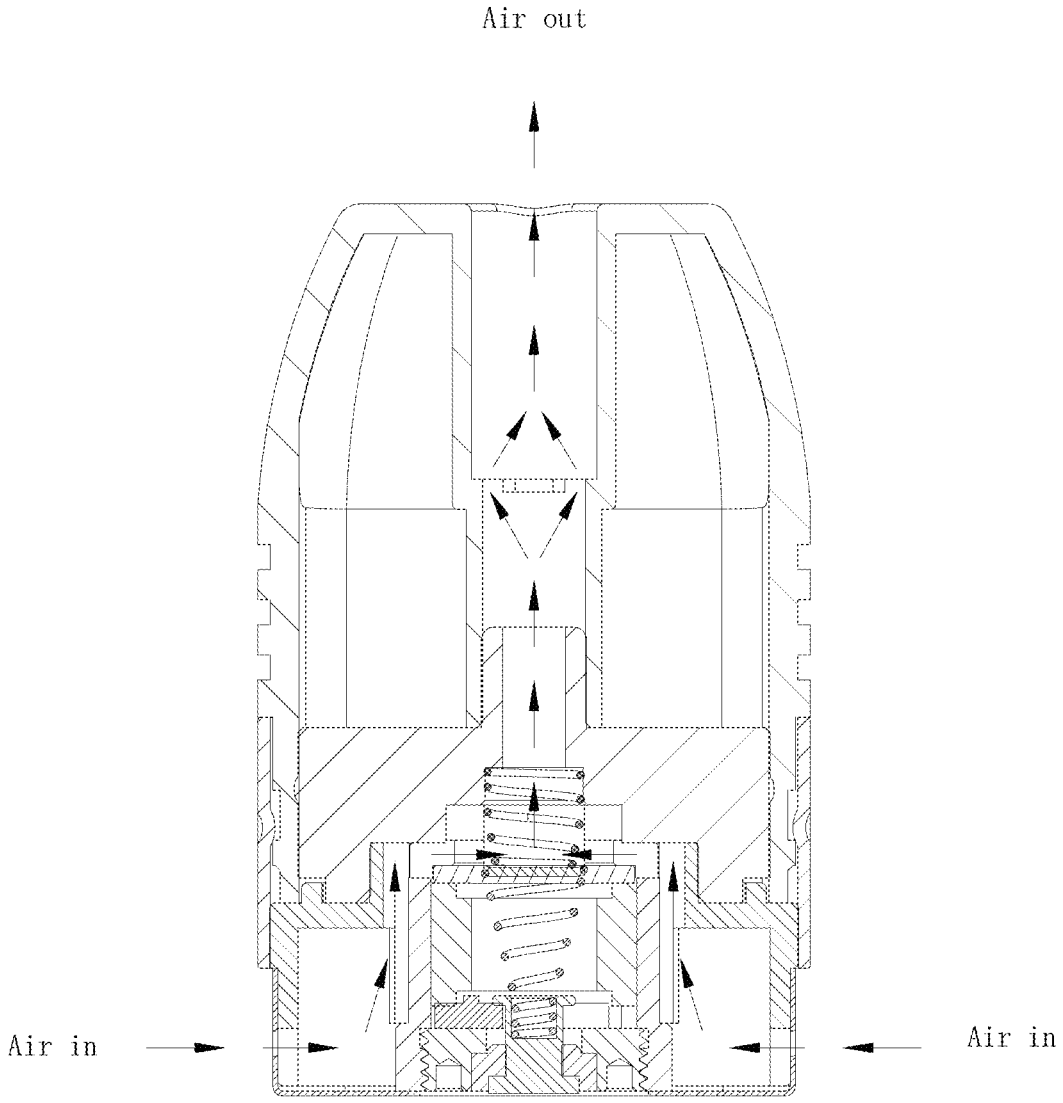
FIG. 4 is a direction diagram of an air path of the present invention.
Figure 5:
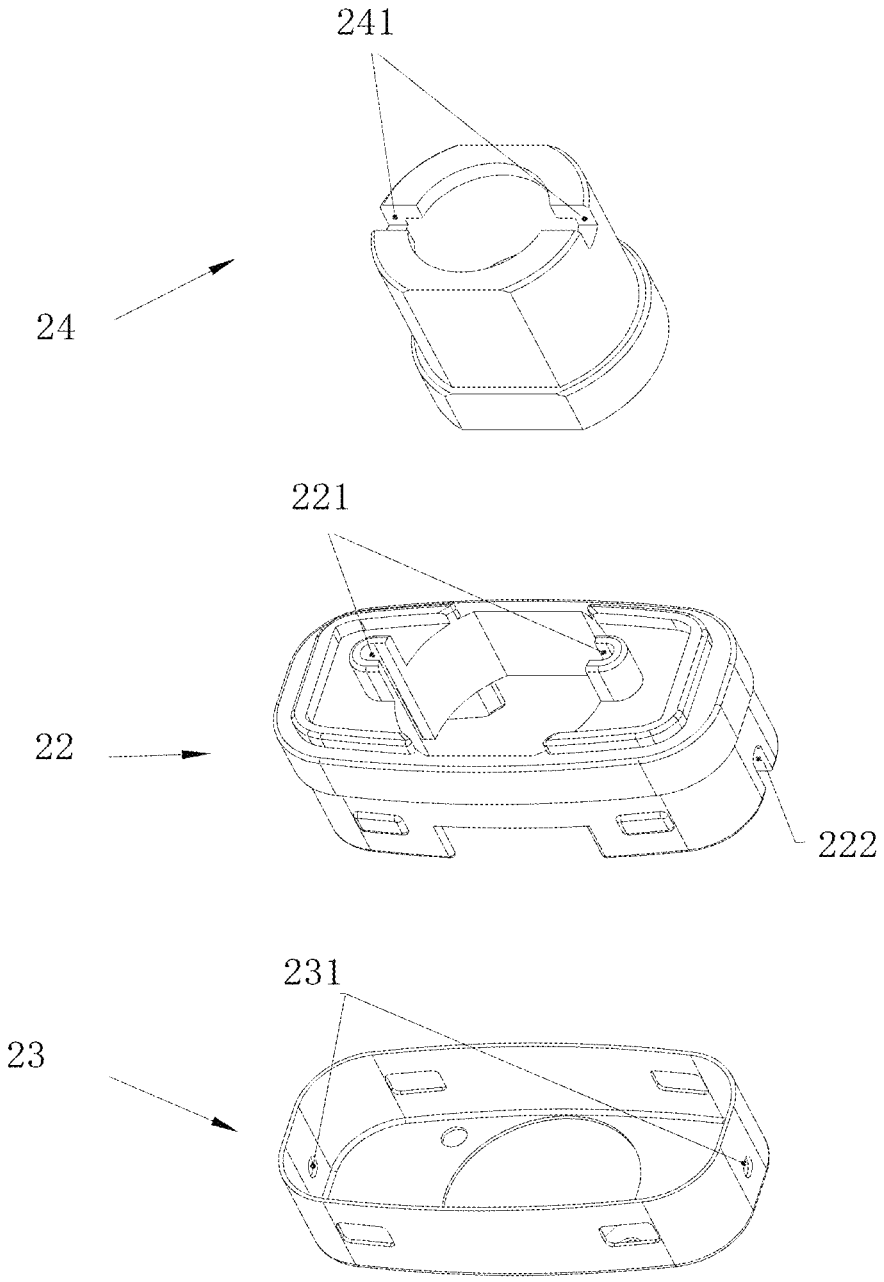
FIG. 5 is a separate structure diagram of an atomization sleeve, a base and a bottom cover of the present invention.
Figure 6:
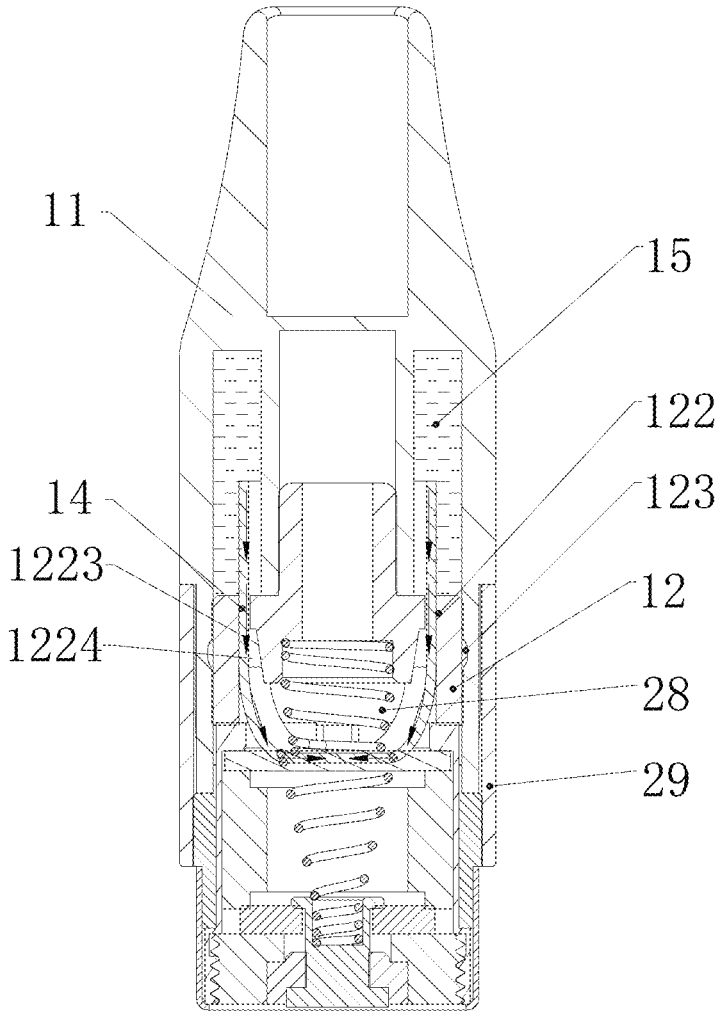
FIG. 6 is a liquid guide state diagram of the present invention.
Figure 7:
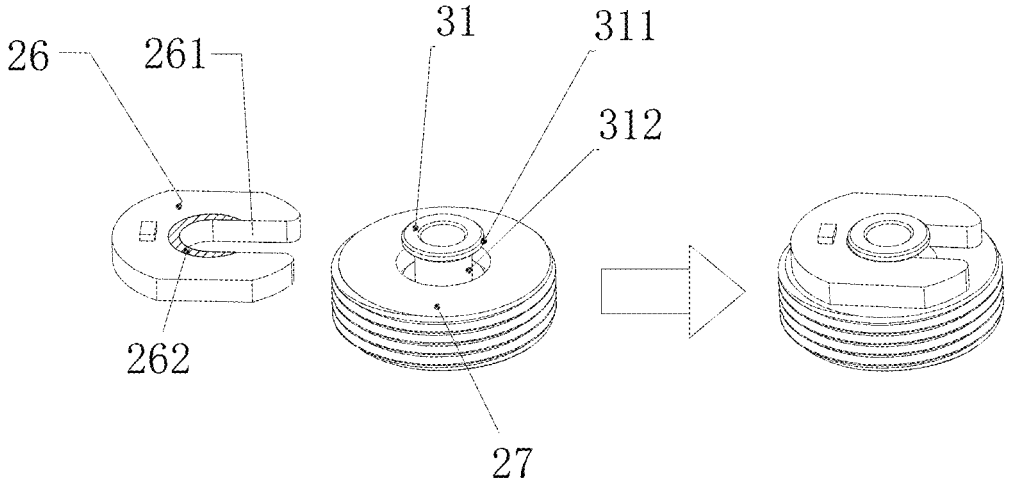
FIG. 7 is an assembly flowchart of a resistor board, a second plug and an electrode sleeve of the present invention.
Figure 8:
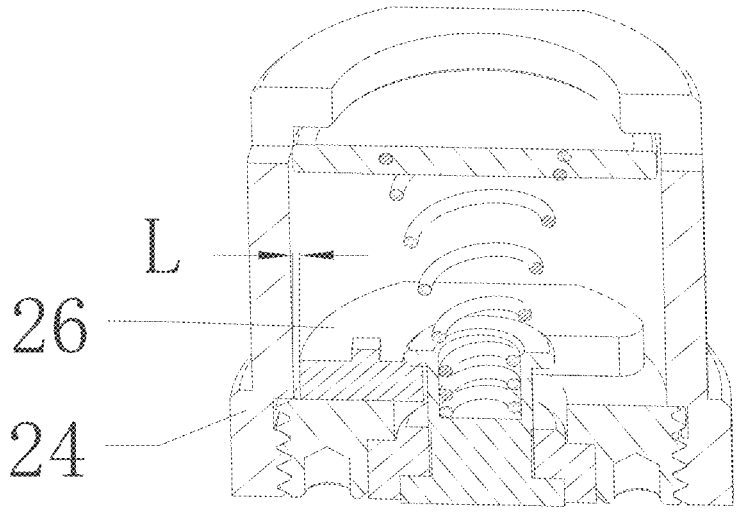
FIG. 8 is a schematic diagram of a gap between the resistance board and the atomization sleeve of the present invention.
Figure 9:
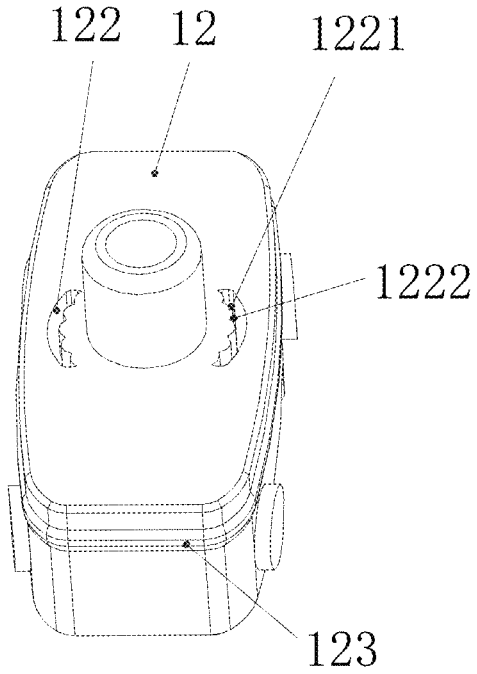
FIG. 9 is a three-dimensional structure diagram of a first plug of the present invention.
Figure 10:
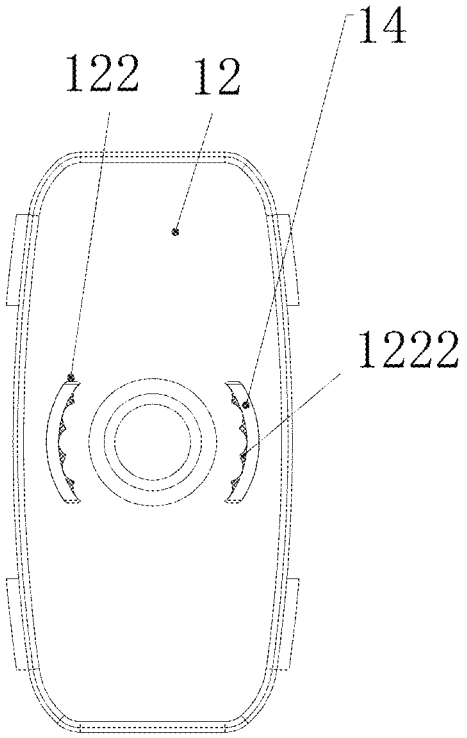
FIG. 10 is a first cooperation state diagram of the first plug and the liquid guide cotton of the present invention.
Figure 11:
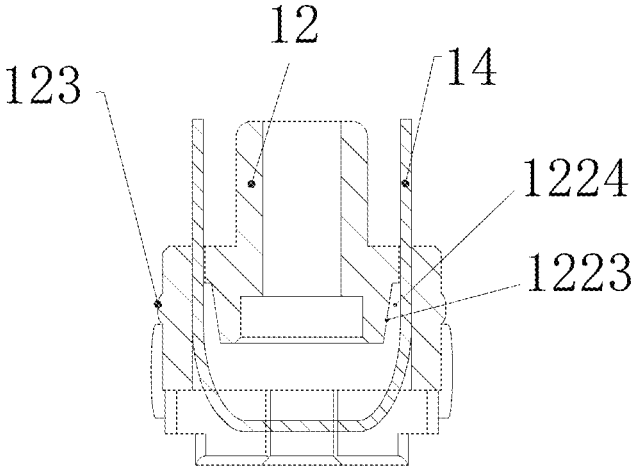
FIG. 11 is a second cooperation state diagram of the first plug and the liquid guide cotton of the present invention.
Figure 12:
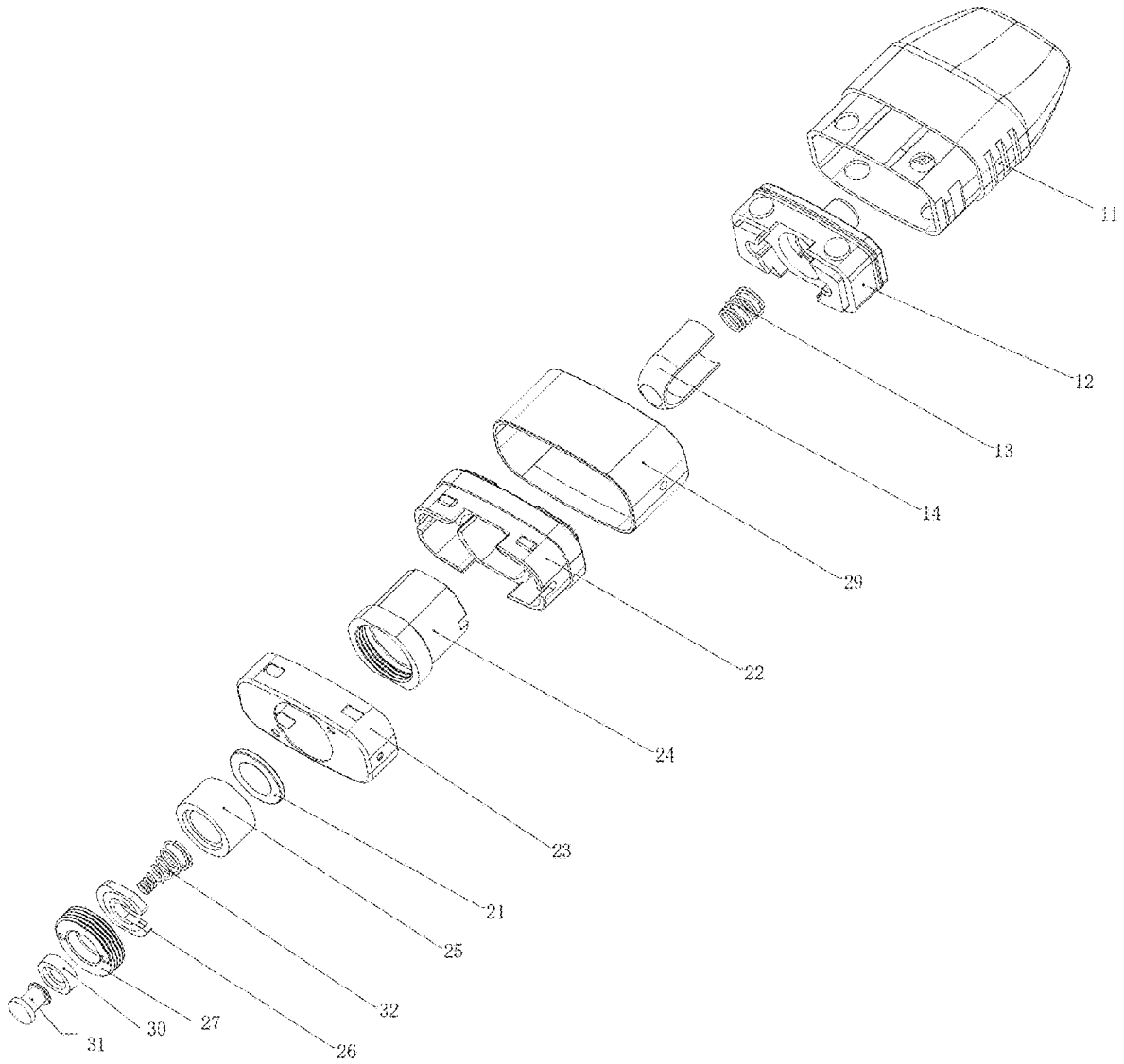
FIG. 12 is an exploded view of the present invention.

As shown in FIGS. 1-12, an embodiment of an electronic cigarette atomizer of the present invention includes a liquid cartridge assembly 1 and an atomization head assembly 2 inserted and combined with each other.

The liquid cartridge assembly 1 includes a liquid cartridge housing 11 and a first plug 12 fastened to each other, the first plug 12 is provided with a through groove 122, a first spring 13 is disposed at the bottom of the first plug 12, the bottom of the first spring 13 is covered by liquid guide cotton 14, and two ends of the liquid guide cotton 14 are inserted into a liquid cartridge 15 in the liquid cartridge housing 11 via the through groove 122. A lower part of the liquid cartridge housing 11 is provided with clamping holes 111, the first plug 12 is provided with clamping columns 121, the first plug 12 is inserted into the liquid cartridge housing 11, and the clamping columns 121 are clamped in the clamping holes 111. The first plug 12 is preferably made of silica gel.

The atomization head assembly 2 includes a base 22, an upper part of the base 22 is sleeved in an outer sleeve 29, a lower part of the base 22 is sleeved with a bottom cover 23, and an atomization sleeve 24 is disposed at middle parts of the base 22 and the bottom cover 23; a first insulating seat 25, a resistance board 26, and a second plug 27 serving as a first power connection terminal are disposed in the atomization sleeve 24 from top to bottom; an ultrasonic atomization piece 21 in contact with the liquid guide cotton 14 is disposed on the first insulating seat 25, an atomization cavity 28 is formed between the ultrasonic atomization piece 21 and the first plug 12, the bottom cover 23 is provided with first air inlets 231, the base 22 is provided with vertical air inlet grooves 221, an upper part of the atomization sleeve 24 is provided with transverse air inlet grooves 241 communicated with the atomization cavity 28, and the first air inlets 231, the vertical air inlet grooves 221 and the transverse air inlet grooves 241 are communicated with each other to form an air inlet channel of the atomization cavity 28; and an air outlet channel for guiding smoke in the atomization cavity out is formed in the liquid cartridge assembly 1. The second plug 27 is preferably made of silica gel.

A second insulating seat 30 and an electrode sleeve 31 serving as a second power connection terminal are sequentially disposed at a middle part of the second plug 27 from outside to inside, and the second plug 27, the second insulating seat 30 and a lower part of the electrode sleeve 31 are fastened together. An upper part of the electrode sleeve 31 extends out of the second plug 27, and an annular inverted structure 311 is disposed on top of the electrode sleeve 31, so that the upper part of the electrode sleeve 31 forms an annular groove 312. The resistance board 26 is disposed on an upper surface of the second plug 27, the resistance board 26 is provided with a U-shaped groove 261, and the U-shaped groove 261 of the resistance board 26 is clamped into the annular groove 312 of the electrode sleeve 31, so that the resistance board 26, the second plug 27, the second insulating seat 30 and the electrode sleeve 31 are fixed to each other. Electrical connection ends are respectively disposed on upper and lower surfaces of the resistance board 26, the upper surface electrical connection end 262 of the resistance board 26 is directly electrically connected to the inverted structure 311 of the electrode sleeve 31, and the lower surface electrical connection end of the resistance board 26 is directly electrically connected to the second plug 27.

The outer circumference of the resistance board 26 and the inner wall of the atomization sleeve 24 are separated by a short distance L, so that the movable space of the assembled resistance board 26 is small. Therefore, compared with the existing method of fixing by soldering, the risk of falling of the resistance board caused by pseudo soldering can be effectively avoided.

An upper surface electrode of the ultrasonic atomization piece 21 is electrically connected to the second plug 27 via the atomization sleeve 24, and a lower surface electrode of the ultrasonic atomization piece 21 is electrically connected to the electrode sleeve 31 via a second spring 32. Ribs 112 and first grooves 113 are disposed on the lower outer circumference of the liquid cartridge housing 11, second grooves (not shown) and first protrusions 291 are disposed on the inner wall of the outer sleeve 29, the lower part of the liquid cartridge housing 11 is inserted into the outer sleeve 29, the ribs 112 are inserted in the second grooves, and the first protrusions 291 are buckled in the first grooves 113.

A plurality of arc-shaped second protrusions 1221 is disposed in the through groove 122, and an air passing gap 1222 is formed between adjacent second protrusions 1221. As such, when the liquid guide cotton 14 absorbs e-liquid and expands in a liquid guide state, air in the atomization cavity 28 can enter the liquid cartridge 15 through the air passing gaps 1222 to ensure that the e-liquid is discharged from the liquid cartridge 15 smoothly, so as to avoid unsmooth liquid guide when the through groove 122 is tightly plugged by the liquid guide cotton 14 and air cannot be supplemented into the liquid cartridge 15.

A sealing body is disposed between the liquid cartridge housing 11 and the first plug 12 to prevent the liquid cartridge 15 from leaking liquid. In this embodiment, the sealing body is a third protrusion 123 integrally disposed on the first plug 12. Obviously, the sealing body may also be a sealing ring disposed between the liquid cartridge housing 11 and the first plug 12. The through groove 122 is provided with an inclined surface 1223 inclined inward at a position corresponding to the sealing body, so that the through groove 122 forms an avoiding space 1224 here to avoid excessively slow liquid discharge when the sealing body is squeezed to deform inward and the liquid guide cotton 14 is clamped too tightly.

The forgoing descriptions are only preferred embodiments of the present application, and do not limit the present application in any form. Although the present application is disclosed above with the preferred embodiments, the present application is not limited thereto. Some variations or modifications made by any skilled person familiar with the art using the disclosed technical contents without departing from the scope of the technical solution of the present application are equivalent to the embodiments, and all fall within the scope of the technical solution.

The invention claimed is:

1. A liquid cartridge assembly for an electronic cigarette, comprising a liquid cartridge housing and a first plug fastened to each other, a liquid cartridge being disposed between the liquid cartridge housing and the first plug, wherein:

the first plug is provided with two through grooves communicated with the liquid cartridge, and two ends of liquid guide cotton pass through the through grooves to extend into the liquid cartridge;

a plurality of second protrusions for squeezing the liquid guide cotton are disposed in the through grooves, and an air passing gap for supplementing air to the liquid cartridge is formed between adjacent second protrusions; and a sealing body is disposed between the liquid cartridge housing and the first plug, and an inclined surface inclined inward is formed in each through groove at a position corresponding to the sealing body, so that an avoiding space is formed in the through grooves.

2. The liquid cartridge assembly for an electronic cigarette according to claim 1, wherein the sealing body is a third protrusion integrally disposed on the first plug.

3. The liquid cartridge assembly for an electronic cigarette according to claim 1, wherein the second protrusions are arc-shaped.

4. An electronic cigarette atomizer, comprising the liquid cartridge assembly for an electronic cigarette according to claim 1.

5. The electronic cigarette atomizer according to claim 4, wherein an atomization head assembly is clamped with a lower part of the liquid cartridge housing, the atomization head assembly comprises an outer sleeve, a rib and a first groove are disposed at the lower part of the liquid cartridge housing, a second groove and a first protrusion are disposed on the outer sleeve of the atomization head assembly, the liquid cartridge housing is inserted into the outer sleeve of the atomization head assembly, the rib is inserted in the second groove, and the first protrusion is buckled in the first groove.

6. The electronic cigarette atomizer according to claim 5, wherein the outer sleeve is sleeved on a base, a lower part of the base is sleeved with a bottom cover, and an atomization sleeve is sleeved at middle parts of the base and the bottom cover; a first insulating seat, a resistance board, and a second plug are disposed in the atomization sleeve from top to bottom; an ultrasonic atomization piece in contact with the liquid guide cotton is disposed on the first insulating seat, an atomization cavity is formed between the ultrasonic atomization piece and the first plug, the bottom cover is provided with a first air inlet, the base is provided with a vertical air inlet groove and a second air inlet communicated with each other, the atomization sleeve is inserted in the base so that the vertical air inlet groove forms a vertical air inlet channel, an upper part of the atomization sleeve is provided with a transverse air inlet groove communicated with the atomization cavity, and the first air inlet, the vertical air inlet channel and the transverse air inlet groove are communicated with each other to form an air inlet channel of the atomization cavity; and an air outlet channel for guiding smoke in the atomization cavity out is formed in the liquid cartridge assembly.

7. The electronic cigarette atomizer according to claim 4, wherein a lower part of the liquid cartridge housing is provided with a clamping hole, the first plug is provided with a clamping column, the first plug is inserted into the liquid cartridge housing, and the clamping column is clamped in the clamping hole.

8. The electronic cigarette atomizer according to claim 4, comprising a second plug serving as a first power connection terminal and an electrode sleeve serving as a second power connection terminal, a second insulating seat and the electrode sleeve are disposed at a middle part of the second plug, and the second insulating seat is disposed between the second plug and the electrode sleeve;

the second plug, the second insulating seat and a lower part of the electrode sleeve are fastened together, an upper part of the electrode sleeve extends out of the second plug, and an inverted structure is disposed on top of the electrode sleeve, so that the upper part of the electrode sleeve forms an annular groove;

a resistance board is disposed on an upper surface of the second plug, and the resistance board is clamped into the annular groove of the electrode sleeve, so that the resistance board, the second plug, the second insulating seat and the electrode sleeve are fixed and combined with each other; and electrical connection ends are respectively disposed on upper and lower surfaces of the resistance board, an upper surface electrical connection end of the resistance board is directly electrically connected to the inverted structure of the electrode sleeve, and a lower surface electrical connection end of the resistance board is directly electrically connected to the second plug.

9. The electronic cigarette atomizer according to claim 8, wherein an outer surface of the resistance board and an inner wall of an atomization sleeve are separated.

10. The electronic cigarette atomizer according to claim 8, wherein the resistance board is provided with a U-shaped groove, and the U-shaped groove of the resistance board is clamped with the annular groove of the electrode sleeve.

11. The electronic cigarette atomizer according to claim 8, wherein the inverted structure is annular.

12. The electronic cigarette atomizer according to claim 8, comprising an atomization head assembly, wherein an ultrasonic atomization piece in contact with the liquid guide cotton is disposed in the atomization head assembly, an upper surface electrode of the ultrasonic atomization piece is electrically connected to the second plug, and a lower surface electrode of the ultrasonic atomization piece is electrically connected to the electrode sleeve.

13. The electronic cigarette atomizer according to claim 8, wherein the second plug is electrically connected to an upper surface electrode of an ultrasonic atomization piece via an atomization sleeve, and the electrode sleeve is electrically connected to a lower surface electrode of the ultrasonic atomization piece via a second spring.

14. An electronic cigarette atomizer, comprising the liquid cartridge assembly for an electronic cigarette according to claim 2.

15. An electronic cigarette atomizer, comprising the liquid cartridge assembly for an electronic cigarette according to claim 3.

* * * * *